US005767877A

United States Patent [19]

Mei et al.

[11] Patent Number: 5,767,877

[45] Date of Patent: Jun. 16, 1998

[54] TONER JET PRINTER

[75] Inventors: Ping Mei, Palo Alto; David Kalman Biegelsen, Portola Valley; James Buckley Boyce, Los Altos, all of Calif.

[73] Assignee: Xerox Corporation, Stamford, Conn.

[21] Appl. No.: 698,008

[22] Filed: Aug. 13, 1996

[51] Int. Cl.[6] ..... B41J 2/04

[52] U.S. Cl. ..... 347/54

[58] Field of Search ..... 347/20, 1, 54; 399/234, 266, 290

[56] References Cited

U.S. PATENT DOCUMENTS 4,647,179 3/1987 Schmidlin .
4,743,926 5/1988 Schmidlin et al. .
4,810,604 3/1989 Schmidlin .
4,814,796 3/1989 Schmidlin .
4,860,036 8/1989 Schmidlin .
4,876,561 10/1989 Schmidlin .
4,894,343 1/1990 Tanaka et al. .

*Primary Examiner*—Benjamin R. Fuller
*Assistant Examiner*—Juanita Stephens
*Attorney, Agent, or Firm*—Oliff & Berridge, P.L.C.

[57] ABSTRACT

A toner jet printer and method of use for printing images by manipulating individual toner particles using two-dimensional print cell arrays built by micro electro mechanical systems (MEMS) technologies. Toner particles are positioned by aerodynamic forces controlled by microvalves within each print cell by either selective or nonselective filling. If selectively filled, each cell is then heated or subjected to an aerodynamic force to eject the toner particles onto a paper substrate. If non-selectively filled, only those print cells corresponding to an intended image are addressed electronically to eject a toner particle from an addressed cell by aerodynamic forces controlled by valve actuation or by heating the print cell. Single color or multiple color printing can be achieved using the same cell array.

27 Claims, 5 Drawing Sheets

TONER JET PRINTER

BACKGROUND OF THE INVENTION

A toner jet printer and method of use for printing images by manipulating individual toner particles using two-dimensional print cell arrays built by micro electro mechanical systems (MEMS) technologies. Toner particles are positioned by aerodynamic forces controlled by microvalves within each print cell. Each cell is then addressed electronically to eject a toner particle from an addressed cell by aerodynamic forces controlled by valve actuation or by heating the print cell. The printer is capable of high-speed, two-dimensional printing.

There are known direct electrostatic printers, such as U.S. Pat. Nos. 4,743,926, 4,814,796, 4,860,036 and 4,876,561, all to Schmidlin and assigned to the same assignee as the present invention, that eliminate an intermediate transfer drum. There are also known micro electro mechanical systems (MEMS) that have been used as basic electro mechanical structures, such as nozzles, suspension beams, hinges and diaphragms. These have proven feasible and sufficiently reliable for use in critical components. Rapid advances of MEMS technologies in recent years have produced commercial products in various application areas. One of these is the ink jet printer. However, until now, such technologies have not been applied to xerographic printing technology.

SUMMARY OF THE INVENTION

The invention relates to a toner jet printer and method of use for printing images by manipulating individual toner particles using two-dimensional print cell arrays. Toner particles are positioned within one or more print cells by either selective or non-selective filling. The particles are attracted to the print cells by a low pressure generated by a pump located on a back side of the cell array. Microvalves associated with each print cell can be selectively addressed to control the filling. If selectively filled, each print cell is then heated or subjected to an aerodynamic force to eject the toner particles onto a paper substrate. If non-selectively filled, only those print cells corresponding to an intended image are addressed electronically to eject a toner particle from an addressed cell by aerodynamic forces controlled by valve actuation or by heating the print cell.

In particular, the invention relates to a toner jet printer for printing on a substrate, comprising: a pressure source; a supply of toner particles, each of a predetermined size; a two-dimensional cell array of print cells relatively positionable under the supply of toner particles and a substrate for receiving an image; and a toner particle ejector. Each print cell comprises: a nozzle on a front side of the cell array sized to receive a toner particle from the supply of toner particles; an orifice on a back side of the nozzle in fluid communication with the nozzle and sized with a diameter smaller than the size of the toner particle; a microvalve located on a backside of the cell array between the orifice and the pressure source, the microvalve controlling fluid communication between the nozzle and the pressure source; and addressing logic for controlling an open/close state of the microvalve to selectively control receipt of and/or ejection of toner particles from within one or more print cells of the two-dimensional array onto the substrate when the substrate is located opposite the front side of the cell array.

BRIEF DESCRIPTION OF THE DRAWINGS

Embodiments of the invention will be described in detail with reference to the following drawings, wherein.

DETAILED DESCRIPTION OF PREFERRED EMBODIMENTS

Figure 1:
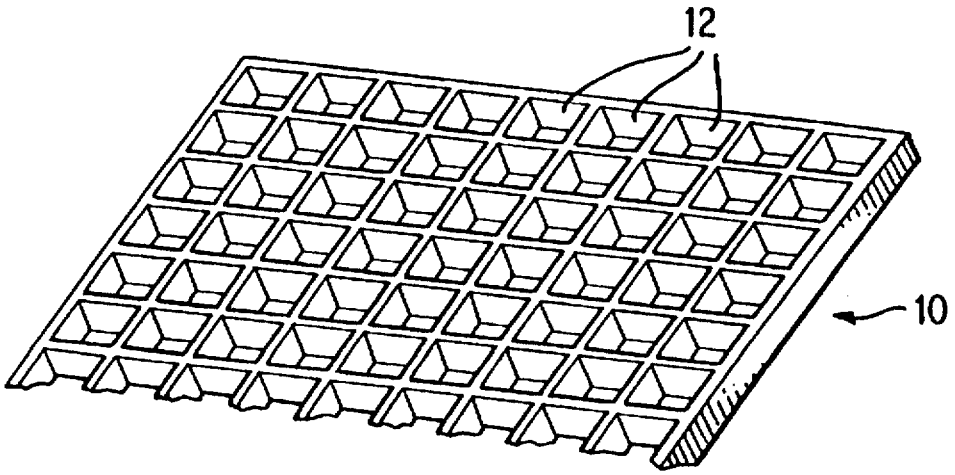
FIG. 1 illustrates a two-dimensional print cell array comprising a plurality of print cells that form a printing plate.
Figure 2:
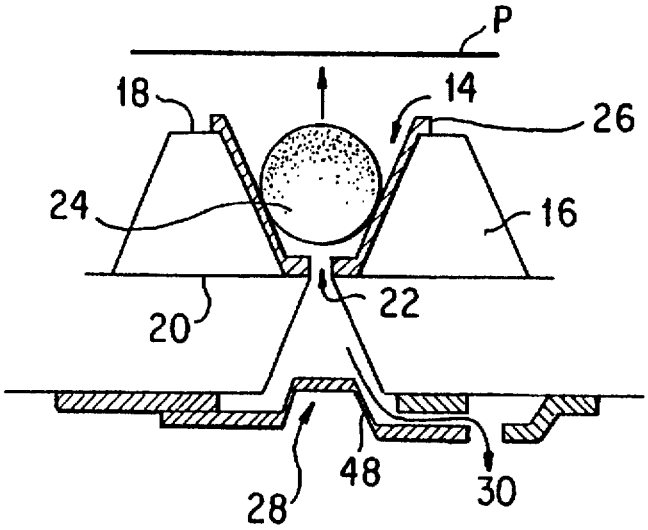
FIG. 2 illustrates the structure of individual toner jet print cells according to the invention.

A toner jet printer according to the invention includes a two-dimensional array 10 of print cells 12 as shown in FIG. 1. Each print cell 12, as shown in FIG. 2, has a nozzle 14 formed by bulk micromachining of a silicon or glass substrate 16. A front side 18 of the print cell faces a print direction and substrate (paper) P. A back side 20 has a small orifice 22 with a diameter smaller than the size of uniformly sized toner particles 24 to be used with the printer.

Figure 8:
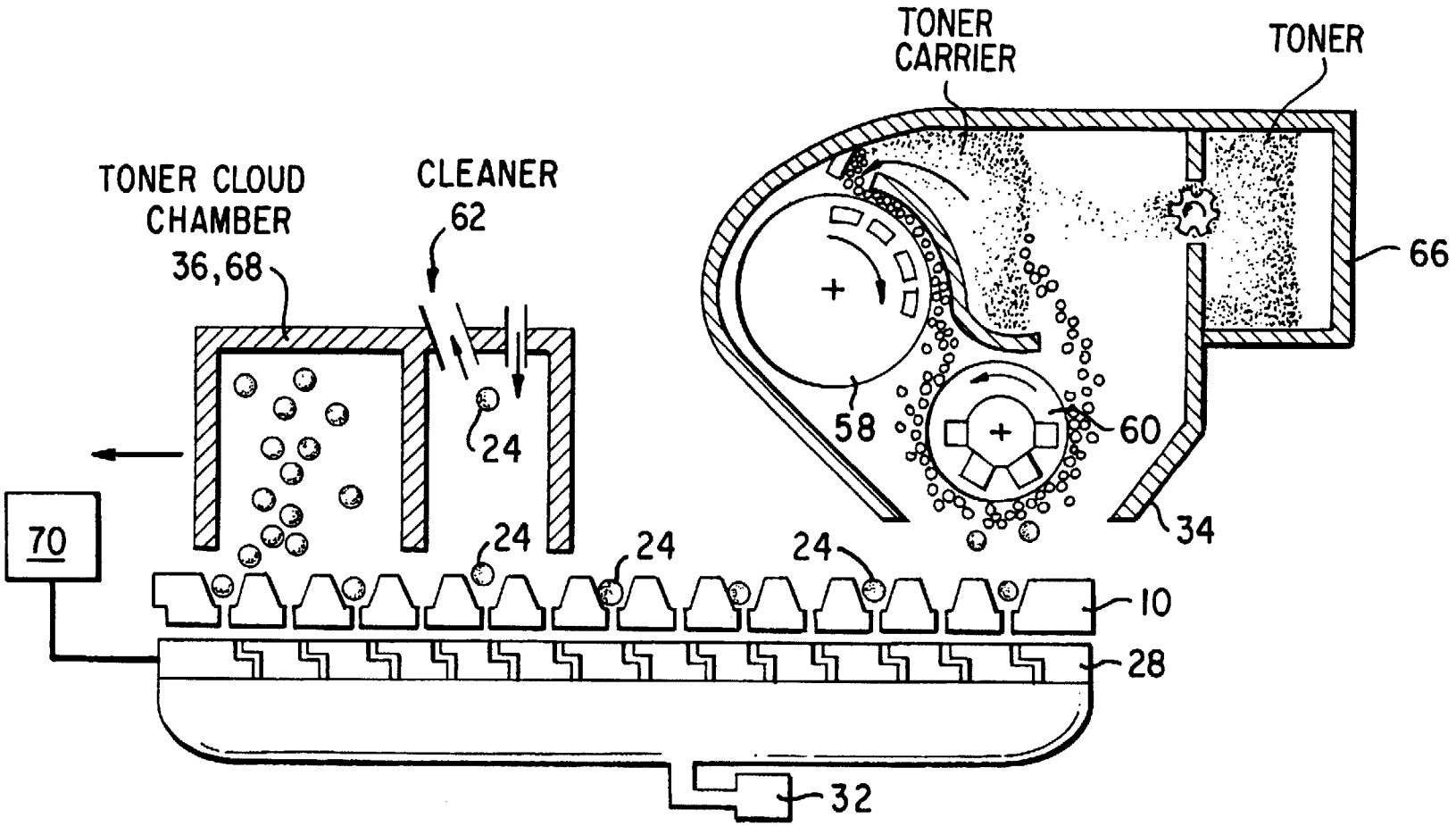
FIG. 8 illustrates exemplary embodiments of filling individual print cells of the printing plate.

The front side 18 of the print cell 12 may have a heating element 26 addressed by a transistor switch. The back side 20 is attached to a microvalve 28 formed by surface micromachining. When open, the microvalves 28 define a flow path 30 between the nozzle and an enclosed rear housing on the back side 20 of the cell array in communication with a pressure source, such as vacuum/air pump 32 (FIG. 8). The microvalves 28 can be addressed either actively or passively depending on the requirements of specific applications.

Under a condition of low pressure generated on the back side of the cell by the vacuum/air pump 32, each nozzle 14 with its microvalve 28 open attracts a toner particle 24 from the front side 18 when the print cell array 10 is opposite a source of toner particles, such as a toner-carrier mixer 34 or toner cloud chamber 36 as better shown in FIG. 8. Each nozzle 14 picks up only one toner particle 24 because the orifice 22 becomes blocked after receiving the toner particle, preventing attraction of additional particles. Excessive toner particles can be removed from the front side of the array by a cleaner. This filling procedure can be performed selectively or non-selectively.

Figure 3:
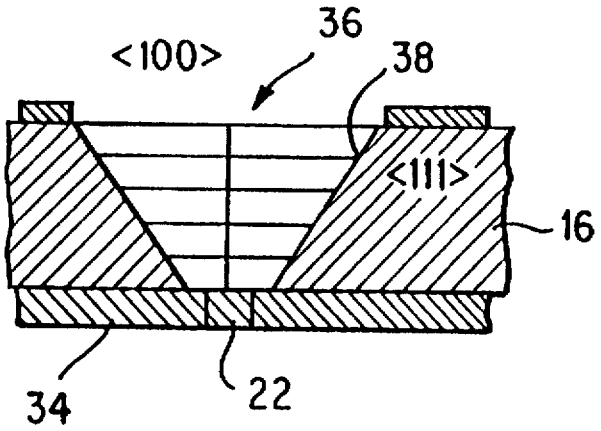
FIG. 3 illustrates a method of fabricating a nozzle and orifice of a print cell.
Figure 4:
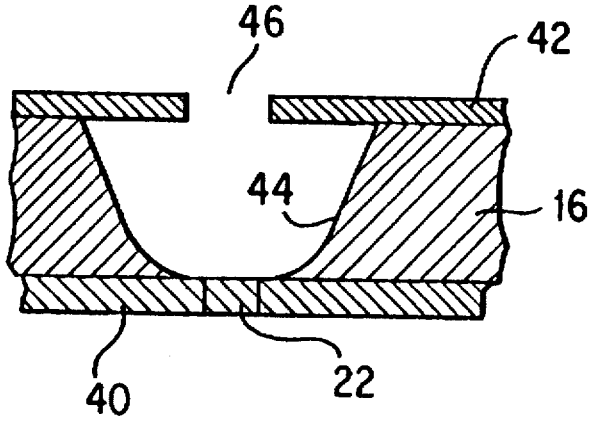
FIG. 4 illustrates another method of fabricating a nozzle and orifice of a print cell.

As shown in FIGS. 3–4, each print cell 12 of the print cell array 10 can be formed by well established bulk micromachining techniques. FIG. 3 shows fabrication of a print cell nozzle 14 on a silicon (Si (100)) wafer 16. The Si (100) wafer 16 has a thin $P^+$ layer 34 on the back side. An opening 36 is first etched by photolithography. Then, a truncated pyramid well 38 is formed by anisotropic etching that is stopped at $P^+$ layer 34. Finally, orifice 22 is formed by etching through $P^+$ layer 34. FIG. 4 shows fabrication of a nozzle 14 on a glass substrate 16. An etch-stop layer (SiN) 40 is deposited on the back side of the substrate 16. An etch mask 42 is formed on the surface of glass substrate 16. A concave well 44 is formed by over etching with a proper opening 46 in the etch mask 42. The orifice 22 is formed by patterning and etching the etch-stop (SiN) 40.

The microvalves 28 of each print cell 12 can be made by surface micromachining. Commonly used microvalves are piezoelectro microvalves and capacitive microvalves. These microvalves can be controlled by transistor switches (active addressing) or by multiplexing row and column signals (passive addressing). Passive addressing is simple and reliable and is thus preferred.

Figure 5:
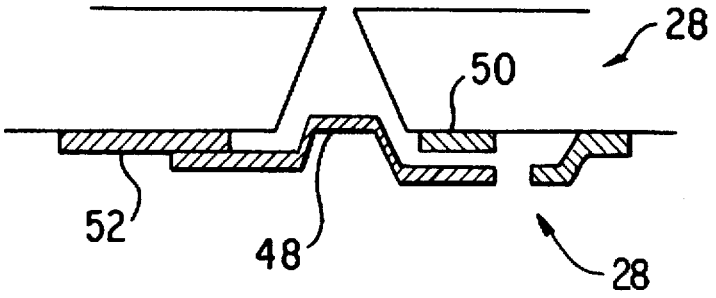
FIG. 5 illustrates an exemplary microvalve active addressing construction.
Figure 6:
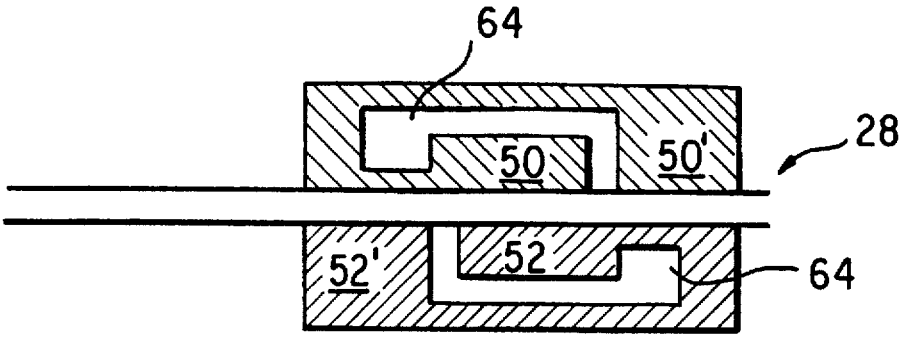
FIG. 6 illustrates an exemplary microvalve passive addressing construction.
Figure 7:
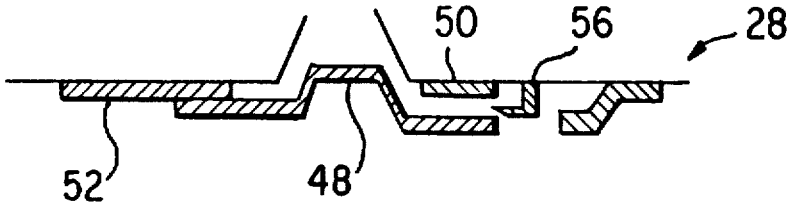
FIG. 7 illustrates another exemplary microvalve passive addressing construction.

FIGS. 5–7 illustrate various methods of addressing microvalves 28. FIG. 5 illustrates an example of active addressing of a capacitive microvalve. Microvalve 28 consists of a conducting plate 48, first main electrode 50 and a flexible part with second main electrode 52. Second main electrode 52 is connected to a bias, such as −5 volts. First main electrode 50 is connected to the drain of an unshown pixel TFT gate. Microvalve 28 is normally open. When the TFT gate is addressed by address logic, first main electrode 50 is charged to +5 volts and the valve is closed.

FIG. 6 is an example of passive addressing. First and second main electrodes 50 and 52 have first and second secondary electrodes 50' and 52', respectively, which are connected to the main electrode by depletion mode TFT channels 64, using, for example, polycrystalline silicon. When the valve is open, electrodes 50' and 52' have the same voltages as the main electrodes 50 and 52 respectively. When electrodes 50 and 52 are addressed by attractive voltages (e.g., +5 and −5 volts respectively), the valve is closed and the TFT channels are turned off. The closed position of the valve is kept by the electric static force between electrodes 50' and 52' when the main electrodes 50 and/or 52 are discharged. An open position is reestablished by applying voltages of the same sign and magnitude to the main electrodes 50 and 52.

FIG. 7 illustrates yet another example of passive addressing. First and second electrodes 50 and 52 are driven by row and column signals respectively. A clip 56 is provided to latch the flexible plate when the valve is addressed to the closed position. To help the motion, clip 56 may have an electrode that is addressed at the same time as 50 and opens as a heated bilayer or electrostatically when the valve is addressed to open.

The microvalves 28 of any of these embodiments can be normally open or normally closed depending on the particular addressing logic used.

Figure 9:
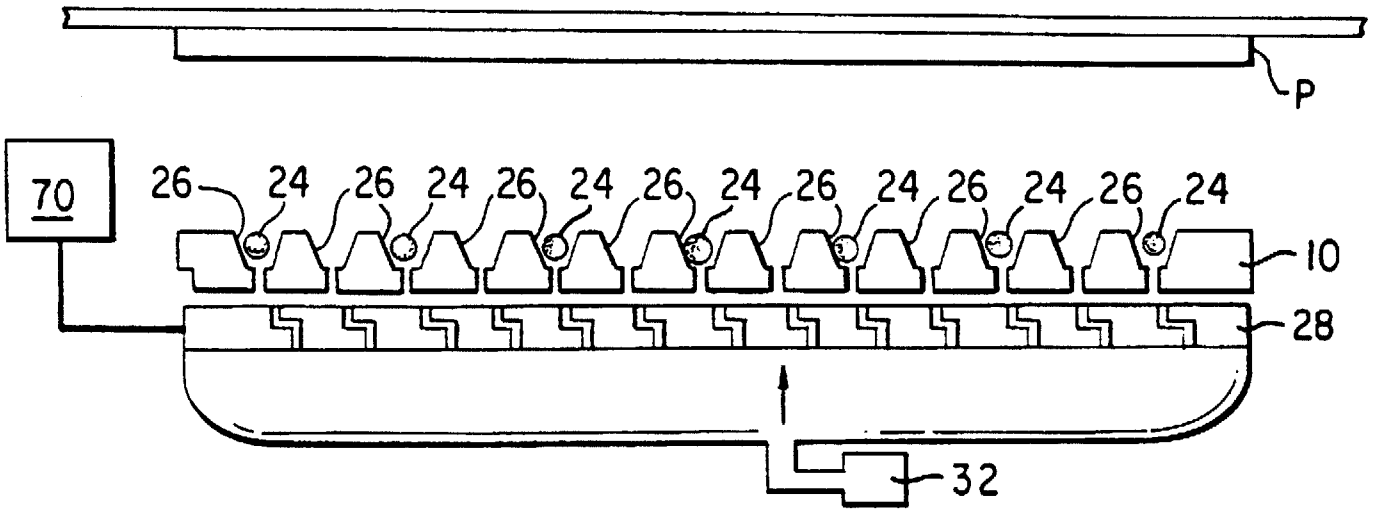
FIG. 9 illustrates an embodiment of printing using the printing plate with selective filling.

The assembled and machined print cells form a two-dimensional array serving as a printing plate as shown in FIGS. 1, 8 and 9. The plate 10 can be of any size, although it preferably is sized to print a complete page in a single pass. Accordingly, it should have dimensions at least as large as the printing area of a particular paper size, such as standard 8.5"×11" or A4.

A filling and printing operation will now be described with reference to FIGS. 8 and 9. Filling can be performed either selectively or non-selectively depending on the particular application and/or personal preference.

Filling is achieved by positioning the printing plate 10 under a supply of toner, which could simply be a toner hopper 66, while applying a low pressure to the back side of the array causing aerodynamic forces to fill the nozzles 14 of print cells 12 having an open microvalve 28. However, to avoid problems with light and small toner particles sticking on the surface of the print cells by electrostatic forces, a traditional toner-carrier mixer 34 and first and second magnetic brushes 58,60 may be used to fill the print cells as shown in FIG. 8. If magnetic toner particles are used, residual particles can be cleaned by known xerographic magnetic brushes. Alternatively, toner particle filling and cleaning could also be performed by passing a toner cloud chamber 68 with a vacuum cleaner 62 over the cell array.

The toner supply can be fixed and the print cell array movable or vice versa. However, for registration, it may be preferable to have the print cell array fixed and the toner supply movable to the print cell array.

For the selectively filled embodiment shown in FIG. 8, the microvalves 28 are controlled by selective addressing of particular cells so that only the microvalves 28 of print cells 12 necessary to print a desired image are open. Accordingly, the low pressure generated by the pump 32 only attracts toner particles 24 to the print cell nozzles 14 in which the microvalves 28 are open as the remaining print cells are closed off from the low pressure source. Toner accumulated in cells with valves closed is removed during the cleaning cycle, whereas toner in cell with valves open remain due to stronger pressure gradients. Excess toner possibly laying over toner bound to cells with valves open is also removed. Addressing logic 70 is used to generate signals causing only those print cells corresponding to a particular image to be filled. This can be achieved by addressing all undesired print cells so that the associated microvalve is closed. Addressing logic 70 is conventional and well known in the art of printing.

Alternatively, filling can be achieved by nonselective filling. As the valves 28 are normally open, applying a low pressure to the back of array 10 will result in toner particles 24 being attracted to all print cells 12 without any addressing. Any excess is then cleaned.

Then, as shown in FIG. 9, a paper P or other substrate for receiving a printed image is positioned opposite the cell array. When positioned, printing can be achieved by use of an aerodynamic force behind the toner particles or by heating the heating elements 26. Conventional paper transport mechanisms are used to position the paper P opposite the cell array. Preferably, the cell array is fixed and the paper P is stopped at the cell array until printing is completed. Then, the transport mechanism outputs the paper P to an output tray or fuser station.

In the selective filling embodiment shown, all microvalves 28 can be closed and all print cells 12 can be heated by addressing all heating elements 26 to eject the toner particles onto the paper P. The particles 24 partially sublime to a gas and are ejected onto the substrate where they cool and become affixed. Alternatively, all microvalves 28 can be opened and positive pressure can be generated by vacuum/air pump 32 behind the cell array 10 to eject the toner particles 24 toward the paper P by aerodynamic forces. This printing can be achieved at very high speed as a complete page can be printed in a single pass without the necessity for an intermediate transfer drum. To ensure adherence to the paper, an electrostatic force can be applied to the back side of the paper P. Then, a downstream fuser can permanently affix the toner to the paper. Adhesion and affixing are the same as described in known prior art.

In an alternative embodiment in which non-selective filling is used, selective printing is performed to print a desired image on the paper P. Toner particles 24 contained in print cells 12 corresponding to an image can be ejected by addressing and closing all microvalves 28 and selectively addressing heater elements 26 corresponding to the selected print cells. Alternatively, selected toner particles 24 can be ejected by closing all microvalves 28, providing a positive pressure on the back side of the array 10 using pump 32, and opening only those microvalves 28 corresponding to print cells necessary to form the desired image.

While in any of the preceding embodiments, printing can be achieved in as few as one pass, it may be desirable to use multiple passes to build up a thicker, more dense image. Additionally, while in its simplest form, the inventive toner jet printer prints in one color, more than one color can be used so that the same cell array can provide highlight or full color printing. This can be realized by printing as above in a first color. Then, the array can be cleaned by a cleaner and refilled using a different color toner. This filling, cleaning and printing process can be repeated any number of times to provide full color printing in a plurality of passes using the same cell array. Alternatively, multiple color printing can be achieved by sequentially filling selected subsets of the print cell array with different colored toner particles and printing in a single pass.

The invention has been described with reference to preferred embodiments thereof, which are illustrative and not limiting. Various changes may be made without departing from the spirit and scope of the invention as defined in the appended claims.

What is claimed is:

1. A toner jet printer for printing on a substrate comprising:

a pressure source of air capable of generating at least a low pressure;

a supply of toner particles, each of a predetermined size;

a two-dimensional cell array of print cells relatively positionable under said supply of toner particles and a substrate for receiving an image; and a toner particle ejection means for ejecting one or more toner particles from within one or more of said print cells onto the substrate, wherein each print cell comprises:

a nozzle on a front side of said cell array sized to receive a toner particle from the supply of toner particles;

an orifice in said nozzle sized with a diameter smaller than the size of the toner particles;

a microvalve located on a back side of said cell array adjacent said orifice and in fluid communication with said orifice and said pressure source of air, said microvalve controlling fluid communication between said nozzle and said pressure source of air; and addressing logic for controlling an open/closed state of said microvalve to selectively control said one or more of said toner particle attracted to said one or more said print cells and the ejection of said toner particles from within said one or more print cells of said two-dimensional array onto the substrate when the substrate is located opposite the front side of said cell array.

2. The toner jet printer of claim 1, wherein said microvalves are all normally open, said pressure source supplies a low pressure on the back side of the cell array when said supply of toner is opposite the front side of the cell array to fill one or more said nozzles of said cell array with a toner particle due to the open microvalves and low pressure.

3. The toner jet printer of claim 2, wherein all print cells are filled with toner particles and predetermined print cells of the cell array are selectively addressed by the addressing logic so that one or more of said microvalves are open and said pressure source serves as said toner particle ejection means by providing a positive pressure to at least the open microvalves causing ejection of toner particles from the predetermined print cells.

4. The toner jet printer of claim 2, wherein said toner particle ejection means includes heater elements located adjacent each said nozzle, each heater element being capable of selective addressing, wherein after filling of the cell array with toner particles, printing of an image on the substrate is achieved by selective addressing of one or more of said heater elements causing said toner particles to eject onto the substrate.

5. The toner jet printer of claim 1, wherein said microvalves are all normally closed, print cells corresponding to an image to be printed are capable of being selectively addressed causing corresponding microvalves to be open, and the pressure source is capable of applying a low pressure on the back side of the cell array when said supply of toner is opposite the front side of the cell array causing toner to fill the nozzles of the addressed print cells.

6. The toner jet printer of claim 5, wherein the pressure source is capable of applying a positive pressure to the addressed print cells having open microvalves, causing ejection of toner particles from the addressed print cells onto the substrate.

7. The toner jet printer according to claim 1, wherein said two-dimensional cell array is made of micromachined silicon.

8. The toner jet printer according to claim 1, wherein said nozzle and orifice are sized to only allow one toner particle to be retained in said nozzle due to blockage of said orifice by the retained toner particle.

9. The toner jet printer according to claim 1, wherein said addressing logic utilizes active addressing.

10. The toner jet printer according to claim 1, wherein said addressing logic utilizes passive addressing.

11. The toner jet printer of claim 1, wherein said microvalves are piezoelectro microvalves.

12. The toner jet printer of claim 1, wherein said microvalves are capacitive microvalves.

13. The toner jet printer of claim 1, wherein said two-dimensional array is sized to substantially correspond to the substrate to be printed on.

14. The toner jet printer of claim 1, wherein said supply of toner particles is a toner hopper having a toner-carrier mixer.

15. The toner jet printer of claim 1, further comprising at least one magnetic brush between said supply of toner and said two-dimensional cell array.

16. The toner jet printer of claim 1, wherein said supply of toner includes a toner cloud chamber.

17. The toner jet printer of claim 1, further comprising a toner cleaner movably located above said cell array.

18. A toner jet printer for printing on a substrate comprising:

pressure means for supplying low or high pressure air;

a toner particle supply means for supplying toner particles of a predetermined size;

a two-dimensional cell array of print cells relatively positionable under said toner particle supply means and a substrate for receiving an image; and a toner particle ejection means for ejecting one or more toner particles onto the substrate, wherein each print cell comprises:

nozzle means on a front side of said cell array sized for receiving a toner particle from the toner supply means;

orifice means in said nozzle means sized with a diameter smaller than the size of the toner particles;

valve means located on a back side of said cell array adjacent said orifice means and in fluid communication with said orifice means and said pressure means, for controlling fluid communication between said nozzle means and said pressure means; and addressing means for controlling an open/closed state of said valve means.

19. A method of direct printing of toner on a substrate using a two-dimensional array of print cells having a nozzle on a front side of said cell array sized to receive a toner particle, an orifice in the nozzle, a microvalve located on a back side of the cell array, the microvalve being in fluid communication with said orifice and a source of pressurized air, said microvalve controlling fluid communication between said nozzle and the source of pressurized air, and addressing logic for controlling an open/close state of the microvalve, the method comprising the steps of:

(a) relatively positioning the front side of the cell array opposite a supply of toner particles of a predetermined size;

(b) filling one or more nozzles of the cell array with one or more toner particles by applying a low pressure to the back side of the cell array using the source of pressurized air;

(c) relatively positioning the front side of the cell array opposite a substrate;

(d) selectively addressing the microvalve to control printing of an image on the substrate; and (e) providing an ejection force to eject toner particles from print cells corresponding to the selectively addressed microvalves to the substrate.

20. The method of claim 19, wherein the step of filling includes passing a toner cloud chamber over the cell array and applying a low pressure to the back side of the cell array to attract toner particles to one or more nozzles of the cell array.

21. The method of claim 19, wherein the step of filling includes passing a toner-carrier mixer over the cell array and applying a low pressure to the back side of the cell array to attract toner particles to one or more nozzles of the cell array.

22. The method of claim 19, further comprising a step of cleaning excessive and unwanted toner particles from the front side of the cell array by passing a vacuum cleaner over the front side of the cell array.

23. The method of claim 19, further comprising a step of cleaning excessive and unwanted toner particles from the front side of the cell array by using magnetic toner particles and passing a magnetic brush over the front side of the cell array.

24. The method of claim 19, wherein during the step of filling each microvalve is open and a low pressure is applied to the back side of the cell array to attract toner particles from a toner supply into each nozzle of the cell array and wherein the step of selectively addressing one or more microvalves includes selectively addressing one or more of the microvalves to print a predetermined image on the substrate.

25. The method of claim 19, wherein the step of filling includes addressing one or more of the microvalves so that only print cells corresponding to a predetermined image to be formed have an open microvalve and are capable of retaining toner therein.

26. The method of claim 25, wherein the step of providing an ejection force to eject toner particles from print cells corresponding to the selectively addressed microvalves includes closing all microvalves and heating a toner particle within at least one print cell.

27. The method of claim 25, wherein the step of providing an ejection force to eject toner particles from print cells corresponding to the selectively addressed microvalves includes generating a positive pressure to the back side of the cell array to create an aerodynamic force through each open microvalve that ejects the toner particles onto the substrate.

* * * * *